United States Patent [19]

Poteet

[11] 4,019,338

[45] Apr. 26, 1977

[54] HEATING AND COOLING SYSTEM

[76] Inventor: Everett E. Poteet, 275 N. Berkshire, Bloomfield Hills, Mich. 48013

[22] Filed: Jan. 9, 1976

[21] Appl. No.: 647,919

[52] U.S. Cl. ..... 62/238; 62/324

[51] Int. Cl.[2] ..... F25B 13/00

[58] Field of Search ..... 62/238, 324, 259; 4/172

[56] References Cited

UNITED STATES PATENTS

| | | | |
|---|---|---|---|
| 3,017,162 | 1/1962 | Haines et al. | 62/238 X |
| 3,498,072 | 3/1970 | Stiefel | 62/506 |
| 3,513,663 | 5/1970 | Martin, Jr. et al. | 62/238 X |
| 3,926,008 | 12/1975 | Webber | 62/238 X |

*Primary Examiner*—William E. Wayner
*Attorney, Agent, or Firm*—Andrew R. Basile

[57] ABSTRACT

A heating and cooling system for heating water contained in a swimming pool while providing a means for cooling or heating the interior of a building. The system includes a compressor connected through suitable conduits to a condenser located in a swimming pool and an evaporator such that, when a fluid heat-transfer medium, such as ammonia, is communicated under high pressure to the condenser, heat is given off thereby, while evaporation of the medium in the evaporator results in a reduction in temperature surrounding the evaporator which, in conjunction with a suitable fan arrangement, may be used to cool the interior of a building. A second condenser is provided with suitable valving and conduit means for selectively communicating the second condenser to the compressor and the evaporator whereby the building may be cooled while not heating the water in the pool. The disclosure includes valving means and suitable sensing devices to permit the communication of the outlet of the first-mentioned condenser with the inlet of the second-mentioned condenser, such that the second condenser functions as an evaporator to permit the water in the pool to be heated while not cooling the interior of the building when the same is not necessary. Additional valving and throttle valves disposed at selected locations in the circuitry permit the selective heating of both the pool and the house.

3 Claims, 3 Drawing Figures

HEATING AND COOLING SYSTEM

BACKGROUND OF THE INVENTION

I. Field of the Invention

The present invention relates to the heating and cooling of fluids and, in particular, the present invention relates to the heating of water in swimming pools while providing for the selective heating and/or cooling of the interior of a building.

II. Description of the Prior Art

As is well known to those versed in the art of heating fluids and cooling building interiors and especially those skilled in the art of heating fluids in vessels, such as the heating of water in a swimming pool, it has heretofore been common practice to withdraw the fluid or water from the vessel or pool and to pass it through a heater or to provide a means for heating the fluid directly in the pool. It is also well known to those skilled in the art that, in the employment of air conditioning units and the like for providing a comfortable and cool atmosphere within a building, substantial amounts of heat are exhausted through the condenser associated with such air conditioning units. While the prior art discloses various means for providing heat for swimming pools, such as that disclosed in U.S. Pat. Nos. 520,342; 3,077,190; and 3,735,807, none disclose applicant's unique system for selectively heating the water in a swimming pool while providing means for selectively heating and/or cooling the interior of a building in an economical and practical fashion.

SUMMARY OF THE INVENTION

The present invention, which will be described subsequently in greater detail, comprises a heat pump having valving and conduit means for the selective communication of pressure fluid to a condenser disposed in conjunction with a swimming pool for heating the water within said pool and returning the fluid to an evaporator disposed within a building for cooling the interior of the building. Suitable conduit and valving means are further provided for heating the water in a swimming pool without cooling the building interior or for heating and/or cooling the building interior, as desired.

It is therefore an object of the present invention to provide a new and improved heating and air conditioning system particularly adapted for use for heating water in a swimming pool while cooling the interior of a building.

It is still an object of the present invention to provide such a system which will also function to heat the interior of a building, yet the system is extremely simple in construction not requiring a separate heat exhaust, such as a furnace, thereby effecting subsantial savings in cost both in installation and in operation.

It is still a further object of the present invention to provide a system of the type described herein having the advantageous characteristics mentioned in the preceding paragraphs which occupies a minimum of space and is highly durable and reliable throughout a long, useful life.

Other objects, advantages, and applications of the present invention will become apparent to those skilled in the art of heating and cooling systems when the accompanying examples of the best modes contemplated for practicing the invention are read in conjunction with the accompanying drawing.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWING

The description herein makes reference to the accompanying drawing wherein like reference numerals refer to like parts throughout the several views, and in which.

DESCRIPTION OF THE PREFERRED EMBODIMENTS

Figure 3:
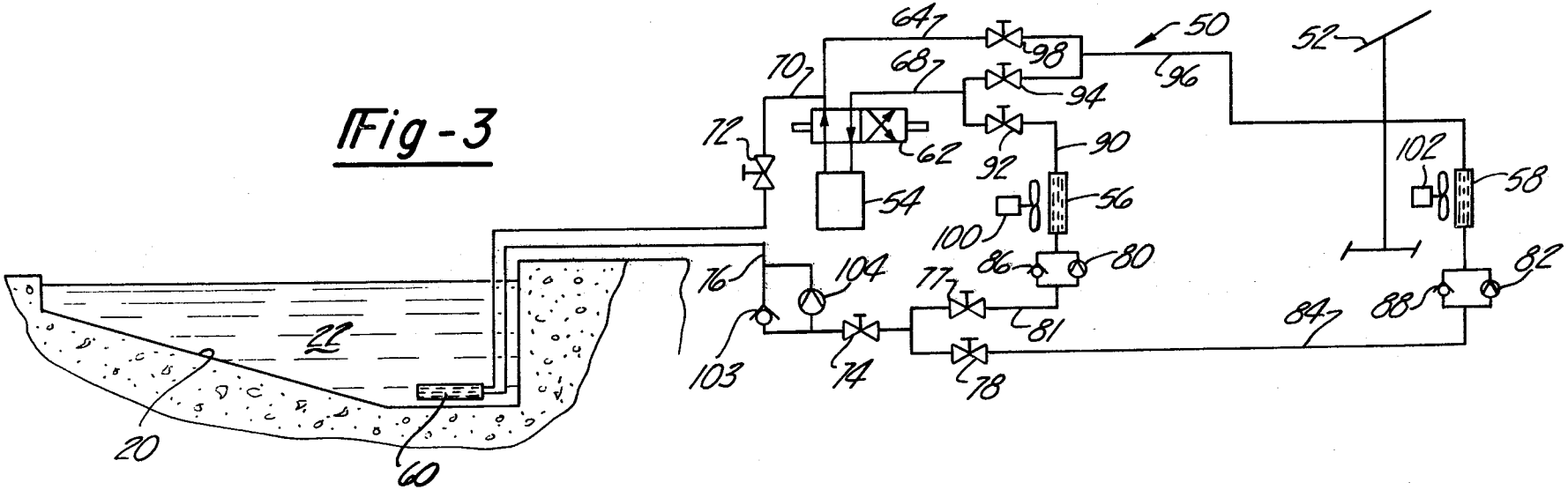
FIG. 3 is a schematic illustration of the present invention employed in conjunction with a swimming pool having water to be heated and a building, the interior of which is desired to be selectively cooled and/or heated.

Referring now to the drawing and, in particular, to FIG. 1 wherein there is illustrated one example of the present invention in the form of a heat pump 10 comprising a compressor 12, a reservoir 14, an evaporator 16, and a condenser 18, all of which are communicated by suitable conduits which will be described hereinafter. The condenser 18 is disposed in a suitable protective housing and disposed at the bottom of a body of water, such as a swimming pool, 20, for the purpose of heating the water 22 contained therein.

A suitable fluid heat-transfer medium, such as ammonia, is evaporated at low pressure in the evaporator 16 and communicated through conduit 24 via reservoir 14 to the inlet side of the compressor 12. Other heat-transfer media that may be employed to evaporate the heat-transfer medium will be described hereinafter. The work of transporting the medium from low to high pressure is accomplished by means of the compressor 12. The compressor draws the vapors from the evaporator 16 and compresses the vapor to a desired higher pressure. The outlet of the compressor 12 is connected by means of conduit 26 to the inlet side of the condenser wherein the vapor is condensed at a higher pressure and gives off heat in so doing. The heat from the vapor of the condensing heat-transfer medium is thus transferred to the water 22 in the pool 20 which may be thereby heated to a desired amount. Suitable sensors, not shown, disposed in the pool 20 may sense the temperature of the water 22 in the pool 20 and control the operation of the heat pump 10. The medium within the condenser 18 is expanded to a low pressure through a suitable throttle valve 28 as the medium is returned to the evaporator 16 via a conduit 27 to begin being evaporated and to repeat the cycle. By means of this cycle the heat-transfer medium within the heat pump 10 is pumped up from a low temperature to a higher temperature which is sufficient enough to heat the water 22 within the swimming pool 20, the necessary work being accomplished by means of the compressor 12.

Figure 1:
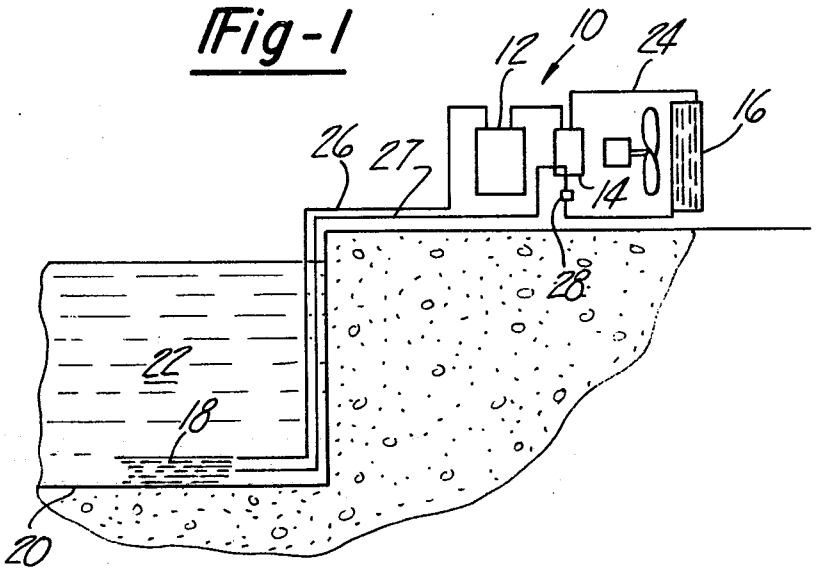
FIG. 1 is a schematic illustration of one example of the present invention employed in conjunction with a swimming pool containing water to be heated.
Figure 2:
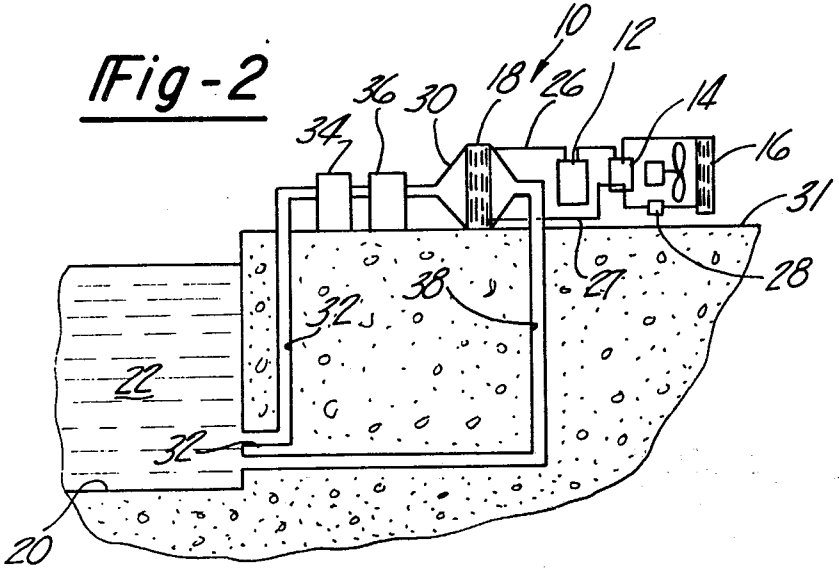
FIG. 2 is a schematic illustration of a second example of the present invention employed in conjunction with a swimming pool containing water to be heated.

In the FIG. 2, the second example of the present invention is illustrated in the form of the heat pump 10 having the same components as described hereinbefore with respect to the embodiment illustrated in FIG. 1 and therefore need not be described again. In the embodiment illustrated in FIG. 2 the condenser 18 is disposed within a suitable housing 30 on the ground surface 31 adjacent to swimming pool 20, while an outlet conduit 32 is provided near the bottom of the pool for drawing water from the pool 20 by means of a pump 34 to communicate the water to the interior of the housing 30 via a suitable and conventional filter 36. Water communicated to the interior of the housing 30 is heated in the same manner as described with respect to the embodiment illustrated in FIG. 1, whereupon the water 22 is returned through a return conduit 38 to the swimming pool 20. Suitable sensing devices, not shown, are operable to control the compressor 12 so as to maintain a proper and desired temperature of the water in a pool. The pump 34 and filter 36 operate in a conventional manner so as to cycle fluid from the pool through the filter 36 to maintain the water in a clean and usable fashion, while the condenser 12 is operable only to provide heat for heating the water 22 passing through the housing 30, as is necessary.

Referring now to FIG. 3 wherein there is illustrated the third embodiment of the present invention in the form of a heating and cooling apparatus 50, adapted to selectively heat the water 22 in the pool 20 or heat and/or cool the interior of a building 52, in a manner which will be described in greater detail hereinafter. The heating and cooling apparatus 50 comprises a compressor 54, an outside coil (evaporator or condenser) 56, an inside coil (condenser or evaporator) 58, and an underwater coil (evaporator or condensor) 60. A directional control valve 62 is adapted to selectively direct fluid under pressure from the compressor 54 to conduits 64 or 68. Conduit 64 is branched at 70 and communicates via an on-off valve 72 with the inlet of the underwater coil (or condensor) 60. The outlet of the underwater coil 60 communicates with an on-off valve 74 via a conduit 76 and check valve 103. The outlet of the on-off valve 74 is, in turn, branched for communication selectively to on-off valves 77 and 78, depending upon which valve is open to provide communication selectively to the evaporator 56 via conduit 71 and throttle valve 80 or the inside coil evaporator 58 via throttle valve 82 which is disposed within a conduit 84 connecting the on-off valve 78 with the intake of the inside coil evaporator 58. Check valves 86, 88, and 103 disposed in the conduits 81, 84, and 76 respectively, permit the flow of fluid in the opposite direction from the coils 56, 58, and 60, respectively, as will be described hereinafter. The outside coil 56 is connected via a conduit 90 and an on-off valve 92 to the return conduit 68 which is also branched to communicate with the inlet side of the inside coil 58 via on-off valve 94 and main conduit 96. The conduit 96 is in direct communication with the outlet conduit 64 via an on-off valve 98.

While not shown, suitable electric circuitry is provided to control the positions of the on-off valves and the directional control valve 62 in response to suitable thermostats disposed in the pool 20 and in the interior of a building 52, so as to actuate the proper on-off valve to cause the desired result, as will be described hereinafter with respect to obtaining a heating and/or cooling effect, as is necessary. Additionally, suitable motor-driven fans 100 and 102 are respectively associated with the outside coil 56 and the inside coil 58 and function in the conventional manner.

In operation, when it is desired to provide heat for the pool 20 so as to raise the temperature of the water 22 to a certain desired level, the four-way valve 62 is actuated to the position illustrated, while the on-off valves 72, 77, 92, and 74 are actuated to an open position, and valves 78, 94, and 98 are closed. It can thus be seen that the flow path will be from the compressor 54 through the directional control valve 62, conduit 70, and on-off valve 72 through the underwater condenser 60 which will result in the condensation of the fluid medium resulting in giving off heat to cause a temperature rise of the water 22. The heating medium is returned via conduit 76 and on-off valves 74 and 77 to the outside coil condenser 56 via the throttling valve 80 which functions in a conventional manner to cause a pressure drop, whereupon the fluid is returned via on-off valve 92 to the compressor 54 via conduit 68; and the cycle is repeated.

When it is desired to heat the pool 20 and cool the interior of the house 52, the directional control valve 62 remains in the position illustrated, while the on-off valves 72, 74, 78, and 94 are shifted to the open position, while on-off valves 77, 92, and 98 are shifted to the closed position. In this manner fluid from the compressor 54 is directed via conduit 70 to the underwater coil 60, whereupon fluid is returned via conduits 76 and 84 to the inside evaporator 58 across the throttling valve 82 which causes a pressure drop of the fluid. The fluid then returns from the evaporator 58 drawing heat from the house and causing a cooling effect as desired. Fluid is then returned to the compressor 54 for recycling, whereby the pool is heated and the interior of the house is cooled.

If the situation results wherein the pool's water temperature is being maintained at the proper level but it is necessary to cool the house, the directional control valve 62 is shifted such that fluid from the compressor 54 is directed to the conduit 68; and the conduit 64 becomes the return line, as will be described. At the same time, the valves 77, 78, 92, and 98 are all open, while the on-off valves 72, 94, and 74 are closed. It can be seen that in this situation fluid is pumped from the compressor 54 through the outside coil condenser 56, across check valve 86, to the inside coil 58 via on-off valves 77 and 78 and throttle valve 82. Fluid passing through the inside coil evaporator 58 results in a cooling effect, and fluid therefrom is returned to the compressor 54 via conduits 96 and 64.

When it is desired to heat both the pool and the house, the directional control valve 62 is shifted to positions illustrated in FIG. 3; and valves 72, 74, 77, 78, 92, and 98 are open, while the valve 94 is closed. This results in fluid being delivered from the compressor 54 and directed simultaneously to both the inside coil 58 and the underwater coil 60, which results in heat being given off from both of these coils. Fluid is then returned from the underwater coil 60 via conduit 76 and on-off valves 74 and 77 to the outside coil 56, while fluid from the inside coil 58 passes over check valve 88 and flows through conduit 84 to on-off valves 77 and 78 and across throttle valve 80 to the outside coil 56. Fluid passing therethrough is directed back to the compressor 54 via conduits 90 and 68.

In the final mode of operation, when it is desired to heat the house only, the directional control valve 62 is shifted such that fluid from the compressor 54 is directed to conduit 68, while on-off valves 74, 78, 72, and 94 are open, and on-off valves 98, 92, and 77 are closed. It can thus be seen that fluid from the compressor 54 is directed to the inside coil 58 resulting in a temperature rise within the house, and fluid from the inside coil 58 passes across check valve 88 through conduit 84 and is returned to the pool coil 60 by means of throttle valve 104 and is returned to the compressor 54 via conduits 70 and 64.

It can thus be seen that the present invention discloses a new and improved means for utilizing a heat pump to provide selectively a heating effect for the water within a swimming pool in conjunction with providing a means for cooling and/or heating the interior of a building; all being accomplished in an extremely simple and inexpensive manner.

While only three examples of the present invention have been disclosed, it should be apparent to those skilled in the art of heating and cooling systems that other forms of the present invention may be had, all coming within the spirit of the invention and the scope of the appended claims.

What is claimed is as follows:

1. A heating and cooling apparatus for heating water contained within a swimming pool while cooling the interior of a building, said apparatus comprising:

a compressor;

a first condenser for heating the water within said pool;

a conduit means connecting the output of said compressor to said first condenser;

an evaporator for cooling the interior of said building, said conduit means connecting the output of said condenser to the intake of said evaporator and the outlet of said evaporator to said compressor;

a first throttle valve disposed in said conduit means between said first condenser and said evaporator;

a second condenser;

first valve means for selectively communicating said second condenser to said compressor and said evaporator for selectively cooling said building while not heating said pool;

second valve means for communicating the outlet of said first condenser to said second condenser; and second throttle means disposed between said first and second condensers whereby said second condenser functions as an evaporator and said pool water is heated while not cooling the interior of said building.

2. The heating and cooling apparatus defined in claim 1 further comprising means for directing fluid from said compressor to said housing evaporator and said pool coil for heating both said housing and said pool simultaneously.

3. The heating and cooling apparatus defined in claim 1 further comprising means for directing fluid from said compressor to said house.

* * * * *